US006611164B2

(12) United States Patent
Uno

(10) Patent No.: US 6,611,164 B2
(45) Date of Patent: Aug. 26, 2003

(54) WEIGHTED MEAN CALCULATION CIRCUIT

(75) Inventor: Masayuki Uno, Ina (JP)

(73) Assignee: Linear Cell Design Co., Ltd. (JP)

( * ) Notice: Subject to any disclaimer, the term of this patent is extended or adjusted under 35 U.S.C. 154(b) by 0 days.

(21) Appl. No.: 09/982,303

(22) Filed: Oct. 17, 2001

(65) Prior Publication Data

US 2002/0093365 A1 Jul. 18, 2002

(30) Foreign Application Priority Data

Oct. 18, 2000 (JP) ..... 2000-317998

(51) Int. Cl.[7] ..... G06F 7/44
(52) U.S. Cl. ..... 327/361; 327/355
(58) Field of Search ..... 327/100, 361, 327/104, 551, 554, 94, 95, 337, 355

(56) References Cited

U.S. PATENT DOCUMENTS 5,708,384 A * 1/1998 Shou et al. ..... 327/356
5,835,045 A * 11/1998 Ogawa et al. ..... 327/91
5,878,171 A * 3/1999 Miyamoto et al. ..... 382/253

OTHER PUBLICATIONS

Technical report of Institute of Electronics, Information and Communication Engineers, published in vol. 08, 1997 entitled: A CMOS Image Sensor for Focal–Plane Compression Using Analog 2–D DCT and ADC/Quantizer, Kawahito, Yoshida et al. in Japanese with an English language abstract and a one page English language explanation of the document prepared by applicant's Japanese patent representative.

* cited by examiner

*Primary Examiner*—Dinh T. Le
(74) *Attorney, Agent, or Firm*—Cook,Alex,McFarron, Manzo,Cummings & Mehler, Ltd.

(57) ABSTRACT

The present invention relates to a weighted mean calculation circuit that comprises an inverting amplifier; a plurality of capacitors C1 through Cn connected to the input terminal thereof; switches SW1 through SWn that connect the capacitors C1 through Cn to the input and output terminals of the inverting amplifier; and a switch SW0 that is provided between the input and output of the inverting amplifier. A signal voltage is applied to respective capacitors while making the SW0 conductive when inputting a signal, and the capacitors C1 through Cn are connected in parallel between the input and output of the inverting amplifier while making the SW0 non-conductive when outputting a signal, whereby an output signal Vout is read, and a weighted mean value output that does not include any offset and is normalized as a normal polarity output can be obtained.

6 Claims, 8 Drawing Sheets

PRIOR ART

WEIGHTED MEAN CALCULATION CIRCUIT

BACKGROUND OF THE INVENTION

The present invention relates to a weighted mean calculation circuit for calculating a mean value by multiplying a plurality of signal voltages by weighting coefficients.

Weighted mean calculations have widely been utilized for an image process in which spatial filtering is carried out on the basis of signals from an image input device, and for a transversal filter that carries out filtering with respect to time-series data for sampling serial data at a fixed interval. Normally, there are many cases where calculations are carried out after analog signals that are sampled with respect to space or time are converted to digital signals by an A/D converter. However, as the number of signals for a calculation input is increased, such a problem arises, in which power consumption and the occupation area in a chip are increased in digital processing.

To the contrary, such a type has been proposed, in which a calculation system is employed with analog values for the purpose of a decrease in power consumption and the occupation area in the chip. FIG. 10 is an exemplary view showing a transversal filter by analog calculations. Inputted analog signals are one by one transferred as time-series analog data by a delay circuit after they are sampled, and respective sampled analog signals are multiplied by a weighting coefficient, wherein the calculated results of output are added together to obtain weighted mean outputs. By varying the coefficient, various filtering can be carried out. Also, normally, a sample hold circuit is used as the delay circuit.

Normally, a calculation circuit having such a type as shown in FIG. 11 is used as a circuit for calculating such weighted mean values. The calculation circuit shown in FIG. 11 includes a operational amplifier in which a non-inverting input terminal is grounded and a switch SW0 and capacitor CO are provided between the non-inverting input terminal and an output terminal; n capacitors C1 through Cn that are connected to the inverting input terminal; and toggle switches SW1 through SWn that are connected to either voltage of signal inputs V1 through Vn secured at the other ends of the respective capacitors or the ground.

In this construction, since the inverting input terminal of the operational amplifier is made into the ground potential in the form of hypothetical grounding if the switch SW0 is turned on and the switches SW1 through SWn are connected to the ground side, the electric charges of all capacitors become zero. Next, if the switch SW0 is turned off and switches SW1 through SWn are connected to the input signal side, the output voltage Vout is obtained by using charge conservation, and becomes as shown in the following expression:

$$Vout=-(C1*V1+C2*V2+\ldots+Cn*Vn)/C0 \quad (1)$$

Herein, if C0 is made into a sum of C1 through Cn as in the expression (2), a normalized weighted mean can be obtained in the form of an inverting output.

$$C0=C1+C2+\ldots+Cn \quad (2)$$

Further, in FIG. 11, the reference voltage applied to the non-inverting input terminal and switches SW1 through SWn are made into the ground. However, a level shift may be performed by setting the reference voltage to an adequate voltage value, in order that output signal range can be effectively determined.

As an example in which such a transversal filter is used, there is an example in which the transversal filter is applied to a matched filter circuit used in a spectrum diffusion communications system for mobile communications and wireless LAN, etc., which are described in Japanese Unexamined Patent Publication Nos. 1997-46231 and 1997-83483, etc. The circuit basically employs the construction shown in FIG. 11. However, the publications describe that the power consumption of the circuit can be decreased by employing an inverting amplifier of a single end input type, which includes a series of odd number of inverters, instead of the operational amplifier.

Although it has been normal until now that calculations to obtain weighted mean values are carried out by using an inverting amplifier circuit as shown in FIG. 11, the results of the calculations become inverted outputs in the circuit. Therefore, it was necessary to add a stage of an inverting amplifier in order to directly compare the results with the original input signals. Also, in a case of digital signal processing, the weighting may be simply altered by using software. However, since it is necessary to change the capacitance of C0 to alter the capacitance of the capacitors C1 through Cn in the construction shown in FIG. 11, another problem arises, which makes the circuit complicated if such a system in which the weighting is changed by controlling it from the outside is used. In addition, further lower power consumption and a smaller occupation area are desired in order to effectively utilize the advantages of analog calculations.

SUBJECT OF THE INVENTION

It is therefore an object of the invention to provide a weighted mean calculation circuit in which output signals are not caused to have any offset with respect to input signals, and it is another object of the invention to provide a weighted mean calculation circuit that enables lower power consumption and a smaller occupation area than any of prior arts.

The invention employs the following means in order to solve the above-described objects. That is, a weighted mean calculation circuit according to the invention includes an inverting amplifier; a plurality of capacitors in which the first terminal is connected to an input terminal of inverting amplifier; switching means for feedback, which is provided between the input and output of the above-described inverting amplifier; switching means that connects the second terminals of the above-described plurality of capacitors to input signals; and switching means that connects the second terminal of the above-described plurality of capacitors to the output of the inverting amplifier.

The weighted mean calculation circuit constructed as described above operates in the embodiment including an input operation mode in which the above-described switching means for feedback is made continuous (on or closed), and a plurality of input signal voltages are applied to the second terminal of the above-described plurality of capacitors, and an output operation mode in which the above-described switching means for feedback is made non-continuous (off or opened), and simultaneously at least two or more capacitors among the above-described plurality of capacitors, in which the input signal voltages are stored, are connected to the output terminal of the above-described inverting amplifier, and in which weighted mean values being the mean values of the results obtained by multiplying a plurality of signal voltage values by weighting coefficients are outputted.

By employing such a system, differentials (Vin−Vth) between the input signal (Vin) and threshold voltage (Vth) of the inverting amplifier are stored in the respective capacitors when operating to input a signal (in the input operation mode), and since the signal charge stored in the respective capacitors are proportionate to the capacitance values and all capacitors are connected in parallel when operating to output the signal (in the output operation mode), the total sum of the signal charges are shared by the capacitors connected between the input and output of the inverting amplifier, wherein a weighted mean value is outputted. Also, since the same capacitance is used while the threshold voltage of the inverting amplifier is as the reference in the both of inputting and outputting operation, the output signals do not have any offset voltage, and simultaneously the output signals are caused to become normal outputs.

Also, since, in a prior art weighted mean calculation circuit, input capacitance to which an input signal voltage is applied was different from the feedback capacitance to obtain an output, it was necessary to adjust both the input capacitance value and feedback capacitance value with respect to alternation of the weighting. However, since the same capacitance is used for the input capacitance and feedback capacitance in the system according to the invention, it is sufficient to change the weighting only in the input capacitance value, and a circuit configuration that varies the weighting by controlling it from the outside by using software can be easily constructed. In addition, since no excessive feedback capacitance is provided, not only the layout area thereof can be reduced equivalent thereto, but also the bias current value of an inverting amplifier to charge and discharge the capacitance can be decreased, whereby the power consumption and the occupation area can be further decreased than in any of the prior art weighted mean calculation circuits.

In the present invention, it is preferable that the above-described inverting amplifier is a CMOS inverting amplifier including a first MOS transistor of a source-grounding type, a second MOS transistor of the same polarity, which is cascode-connected thereto, and a load type third MOS transistor of the polarity opposite thereto. If such an inverting amplifier composed of the first MOS transistor and second MOS transistor, which are cascode-connected, is used, the gain can be increased using only one stage of the inverting amplifier to enable a decrease in power consumption and simultaneously increase the operating rate.

In the present invention, it is preferable that the above-described plurality of input signal voltages are applied in parallel by a plurality of terminals, a switch connected to the corresponding input signal terminal and a switch connected to the output terminal of the above-described inverting amplifier are provided at the second terminals of all the capacitors, whereby it is possible to output a weighted mean calculation value after input signals are simultaneously applied to respective capacitors with respect to a plurality of signals applied in parallel.

Also, in the invention, it is preferable that the above-described plurality of input signal voltages are applied from one terminal in series, switches connected to a common node are provided at the second terminal of all the capacitors, and simultaneously the above-described common node has a switch connected to the input signal terminal and a switch connected to the output terminal of the above-described inverting amplifier. With such a construction, it is possible to output weighted mean calculation values with respect to the input signals applied one after another in a time series.

In the invention, it is preferable that an element that constitutes one capacitor with respect to one input signal among a plurality of capacitors corresponding to the input signal voltages is further composed of a plurality of capacitors, and simultaneously, connection of a plurality of capacitors corresponding to the input signal is varied by a control signal from a control section, whereby it is possible to vary the weighting. Therefore, since applied control signals can be varied from the outside, alternation of coefficients can be carried out by modifying the software, wherein the invention can be used for various uses.

Also, in a case where components of capacitance inputted with respect to one signal voltage is composed of a plurality of capacitors, it is preferable that the ratio of capacitance values are made into 2 to the power of J (J is the integral number) like 1:2:4:8, whereby it is possible to maximize the range of variation of the weighting with a slight number of control signals.

Further, it is preferable that either one of the voltage values which are obtained by equally dividing two voltage values, which become the reference, into "n" pieces is selectively inputted as a plurality of input signal voltage values. Input voltages which are in such a relationship are selected and combined, and provided to the respective capacitors, whereby it is possible to constitute a digital-analog converter (D/A converter).

In addition, it is preferable that a plurality of input signal voltages are provided with either one of the two voltages that become the reference is selectively provided, and the ratio of a plurality of capacitors is in a relationship where it is made so as to have 2 to the power of J (J is the integral number) like 1:2:4:8, whereby it is possible to constitute a digital-analog converter (D/A converter) that can obtain an optional output with minimized control.

As a further detailed composition of the invention, the above-described inverting amplifier is made into a CMOS inverting amplifier, whose stage of amplifier is singular, that includes a source-grounding type first MOS transistor, a second MOS transistor of the same polarity, which is cascode-connected thereto, and third MOS transistor, which is used as a load, having the polarity opposite to that of the above-described first MOS transistor, the above-described capacitance is constructed as a capacitance element formed on the MOS process, and the switching means are also respectively-constructed by using a MOS transistor.

DETAILED DESCRIPTION OF THE EMBODIMENTS

Embodiment 1

Figure 1A:
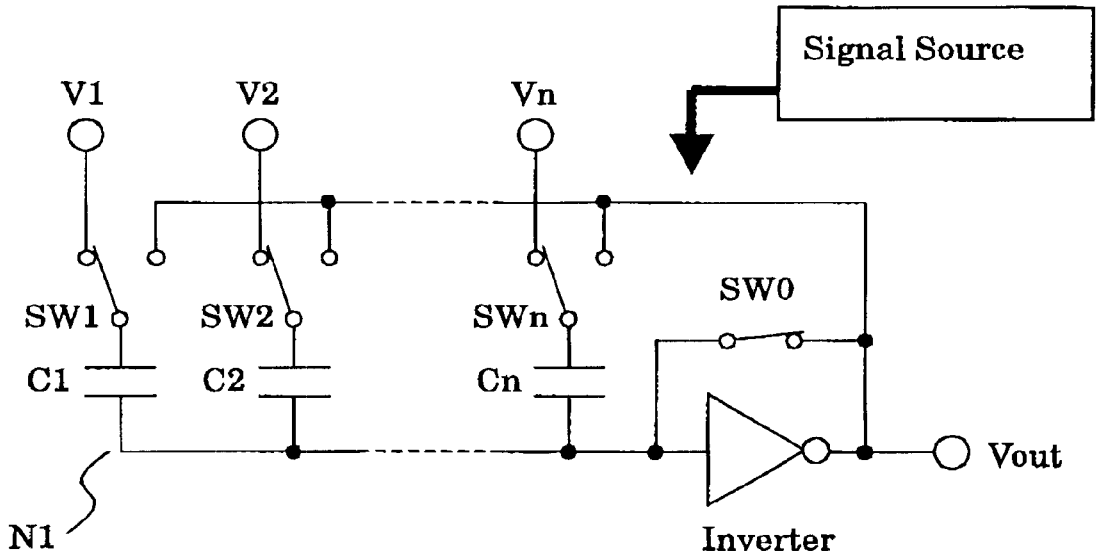
FIGS. 1(*a*) and (*b*) are views of circuit operation, that express operations of a weighted mean calculation circuit according to a first embodiment using the invention.
Figure 1B:
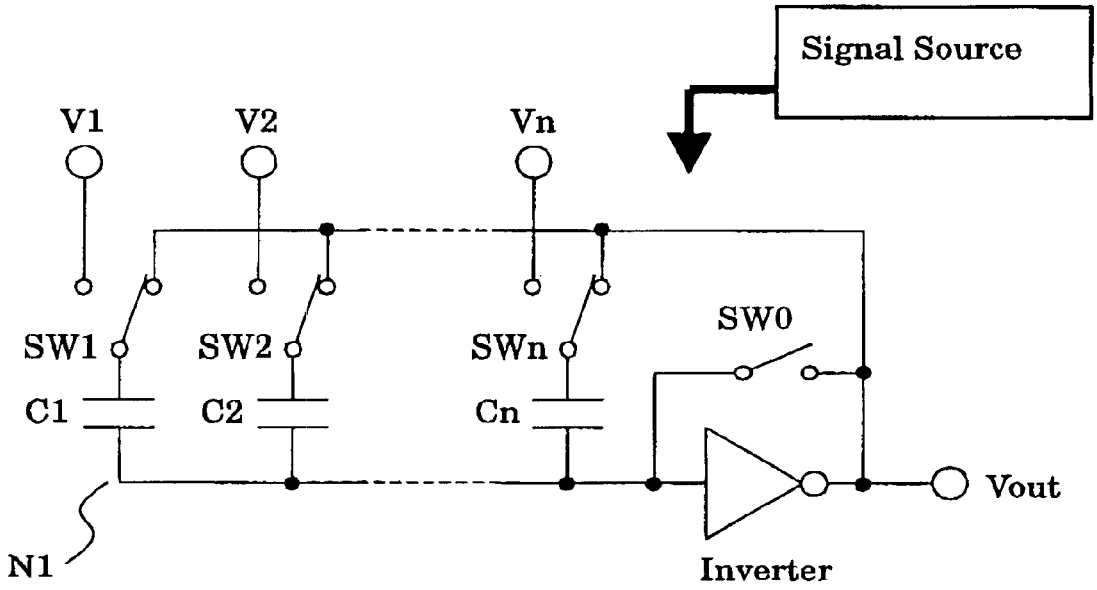

FIG. 1 shows the first embodiment to explain a weighted mean calculation circuit system according to the invention. FIG. 1A shows a connection when a signal input operation is carried out, FIG. 1B shows a connection when a signal output operation is carried out. The first embodiment includes an inverting amplifier (inverter); n capacitors C1 through Cn whose one end is connected to the input thereof; a switch SW0 that is provided to short-circuit between the input and output of the inverting amplifier; and switches SW1 through SWn to control whether the capacitor C1 through Cn are connected to input signal voltages V1 through Vn or the output terminal of the inverting amplifier.

In such a construction, as shown in FIG. 1A, when operating to input a signal, the SW0 is turned on and SW1 through SWn are connected to the input signal terminal side according to control signals of the signal source. At this time, since the input and output of the inverting amplifier are short-circuited by the SW0, the voltage of the input terminal node N1 of the inverting amplifier becomes a threshold value voltage Vth of the inverting amplifier. Therefore, a charge accumulated in the node N1 is expressed by the expression (3);

$$Q=C1*(Vth-V1)+C2*(Vth-V2)+\ldots+Cn*(Vth-Vn) \quad (3)$$

Next, as an operation shown in FIG. 1(*b*) is carried out to output a signal, the SW0 is turned off, and simultaneously the SW1 through SWn are connected to the output terminal side of the inverting amplifier according to control signals of the signal source, and the C1 through Cn are connected in the form of applying feedback in parallel between the input and output terminals of the inverting amplifier. At this time, if an open loop gain of the inverting amplifier is sufficiently high, the input terminal voltage of the inverting amplifier remains maintained at Vth by the feedback of the capacitors C1 through Cn. Therefore, if the output voltage is set to Vout, the accumulated charge Q' is expressed by expression (4).

$$Q'=(C1+C2+\ldots+Cn)*(Vth-Vout) \quad (4)$$

Since Q=Q' by the charge conservation, the relationship between Vin and Vout is expressed by equation (5), and it is understood that the output voltage Vout is a weighted mean voltage value that is obtained by multiplying the input signal voltage V1 through Vn by normalized capacitance ratios of C1 through Cn and adding the same. Also, as has been seen in the expression (5), the output voltage Vout is not influenced by the threshold value voltage Vth of the inverting amplifier and at the same time is a normal output.

$$Vout=(C1*V1+C2*V2+\ldots+Cn*Vn)/(C1+C2+\ldots+Cn) \quad (5)$$

Thus, with the weighted mean calculation circuit having the construction and operation mode, which are shown in FIG. 1, the weighted mean value that is obtained by multiplying the input signal voltages V1 through Vn by the capacitance ratios of C1 through Cn is not influenced by the threshold value voltage of the inverting amplifier, and can be obtained directly from the output terminal of the inverting amplifier as normal outputs.

Also, in the system, since no feedback capacitance C0 that is described in the prior art exists, respective coefficients of the weighted means is sufficient based on only consideration into the capacitance ratios of the C1 through Cn, wherein it is easy to make a design with respect to the respective coefficients, and at the same time, since it is possible to further minutely control the respective coefficients using the switches by further constructing the respective capacitance with respect to one input signal of a plurality of capacitors as shown in the fourth embodiment, a construction in which the coefficients can be varied from outside by using a software can be easily achieved. In addition, since no feedback capacitance is provided, the layout area can be decreased, and simultaneously, since a charge is stored in advance in the capacitors C1 through Cn when inputting signals, an electric current for charging and discharging of the feedback capacitance, that was necessary in the prior arts, is not required any longer. Therefore, since only load capacitance is driven by the inverting amplifier, the biasing current of the inverting amplifier, which is necessary to obtain the same operation rate, can be decreased, wherein lower power consumption can be achieved.

As described above, the advantages of the weight mean calculation circuit in which the present invention is employed are summarized as follows;

(1) Since the outputs are normal polarity outputs not having any offset, no other circuit is required.

(2) The capacitance ratios can be determined without taking the feedback capacitance into consideration, and then it is easy to handle.

(3) No excessive feedback capacitance is provided, and lower power consumption and smaller occupation area can be brought about.

Embodiment 2

Figure 2:
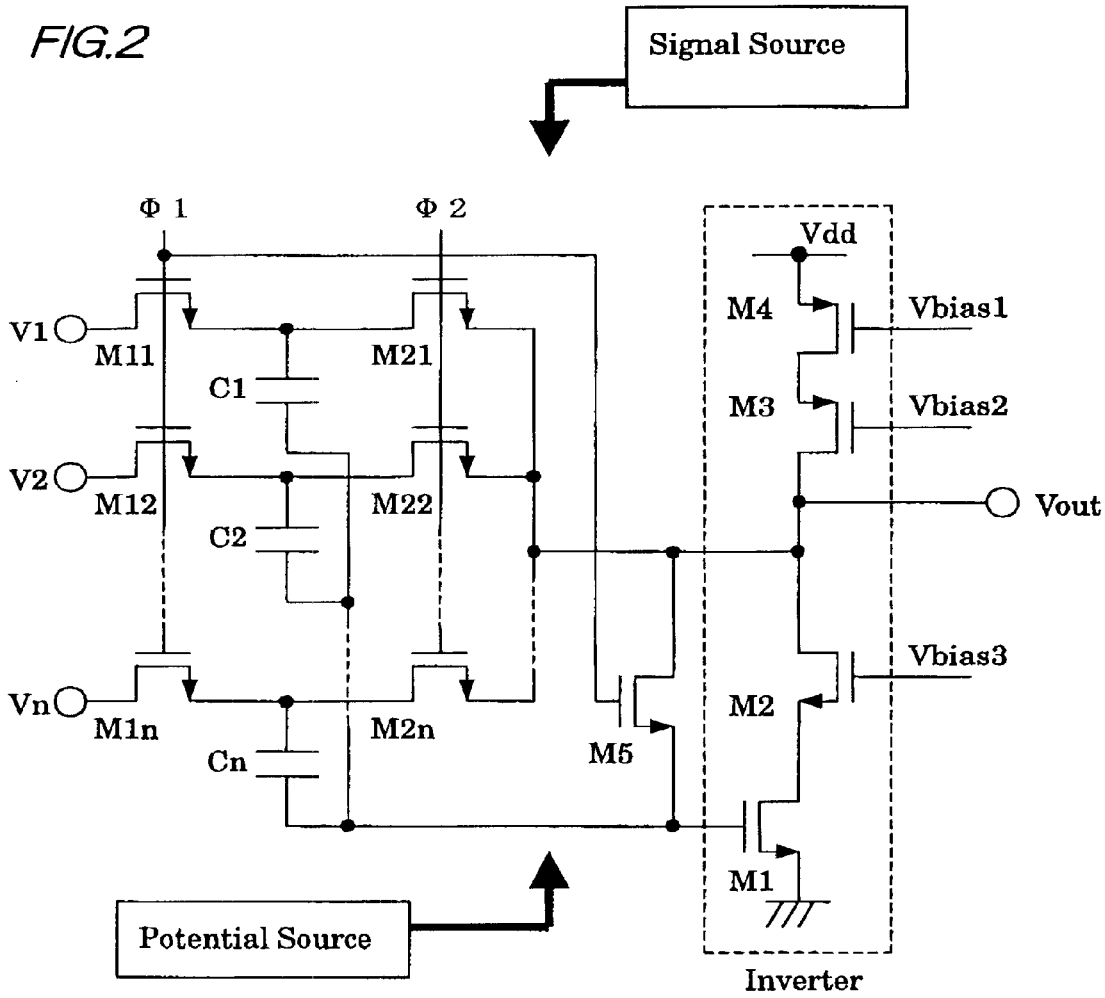
FIG. 2 is a circuit diagram showing a second embodiment of a weighted mean calculation circuit according to the invention.

Next, with reference to FIG. 2, a description is given of the second embodiment consisting of a further detailed circuit configuration. As the inverting amplifier shown in FIG. 1, the circuit in FIG. 2 uses a CMOS inverting amplifier that includes a source-grounding type (common-source configuration) nMOS transistor M1, an nMOS transistor M2 that is cascode-connected to the drain of the transistor M1 and whose gate is provided with a constant voltage Vbias3, a pMOS transistor M4 that operates as a constant-current type load and whose gate is provided with a constant voltage Vbias1, and a pMOS transistor M3 that is cascode-connected to the drain of the transistor M4 and whose gate is provided with a fixed voltage Vbias2. Also, the switch SW0 is an nMOS transistor M5, and switches SW1 through SWn are two nMOS transistors of nMOS transistors M11 through M1n whose gate is provided with Φ1 from the signal source and nMOS transistors M21 through M2n whose gate is provided with Φ2 from the signal source, wherein one toggle switch in FIG. 1 is constituted. The above voltages Vbias1 through Vbias3 are provided by the potential source. Ends at one side of these switches are connected to capacitors C1 through Cn to hold input signals, and the other ends of the nMOS transistors M11 through M1n are connected to the input terminals while the other ends of nMOS transistors M21 through M2n are connected to the output terminals which are outputs of the CMOS inverting amplifier. In addition, the other ends of the capacitor C1 through Cn are commonly connected to the gate of the nMOS transistor M1, which is the input of the inverting amplifier. Also, with respect to the switching transistors, in FIG. 2, only the MOS transistor is shown. However, if the switching transistor is composed of a CMOS analog switch in which transistors of both polarities of nMOS and PMOS are coupled together and used, it is possible to widen the range of input signals.

Figure 3:
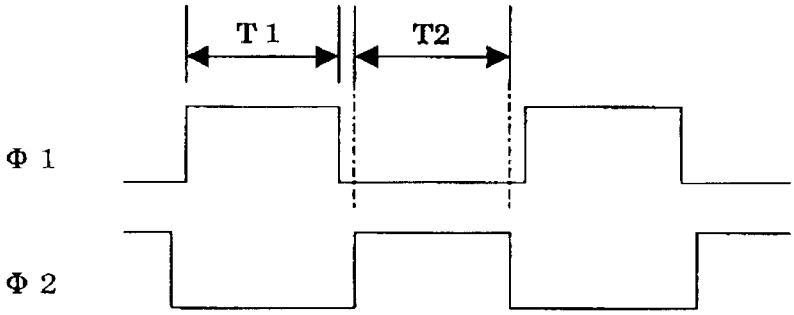
FIG. 3 is a timing chart explaining the operations with regard to FIG. 2.

Next, a description is given of the operations shown in FIG. 2, using the timing chart in FIG. 3. The weighted mean calculation circuit is composed of two operation modes. That is, one of the operation modes is an input operation mode showing a term T1 in which Φ1 becomes "H", and the other is an output operation mode showing a term T2 in which Φ2 becomes "H". In FIG. 3, there is a term in which both signals are made into "L" in the process from the state where Φ1 is "H" to the state where Φ2 is "H". This term is provided to prevent the output from becoming inaccurate due to flow-out of a part of the charge accumulated in the capacitance in a case that both signals are made into "H" at the same time.

Since, in the input operation mode of the term T1, the nMOS transistors M11 through M1n and M5 are turned on and transistors M21 through M2n are turned off according to control signals Φ1, ϕ2 of signal source, input voltages V1 through Vn are provided into the capacitors C1 through Cn. At this time, the gate voltage of M1, which is an input of the inverting amplifier, is made into a threshold value Vth of the inverting amplifier because the input and output of the inverting amplifier are short-circuited by the nMOS transistor M5. The gate voltage is voltage Vgs1 between the source and gate of the MOS transistor M1, which depends upon the bias current value provided by the pMOS transistor M4, whereby potentials (V1−Vgs1), (V2−Vgs1), . . . , (Vn−Vgs1) are stored in the respective capacitors.

Next, as the output operation mode of the term T2 is brought about, the nMOS transistors M11 through M1n and M5 are turned off and M21 through M2n are turned on according to control signals Φ1, ϕ2 of signal source, the capacitors C1 through Cn are connected in parallel between the input and output of the inverting amplifier. Thus feedback is made effective by the capacitance, and the gate potential of M1 is kept on Vgs1, wherein since the charge accumulated in the respective capacitors is shared by the capacitors C1 through Cn1 that are connected in parallel, a weighted mean value shown in the expression (5) is caused to appear in the output terminal Vout. As has been understood in FIG. 2, since the circuit configuration is very small-sized and the bias current is permitted to flow into only the one-staged inverting amplifier, a small occupation area and lower power consumption can be achieved.

Embodiment 3

The weighted mean calculation circuits shown in FIG. 1 and FIG. 2 show a configuration in which input signals V1 through Vn are provided in parallel. However, a description is given of a weighted mean calculation circuit of serial data with reference to FIG. 4 that shows a configuration in which input signals are provided one after another in a time series, and FIG. 5 that shows a timing chart of its operation.

Figure 4:
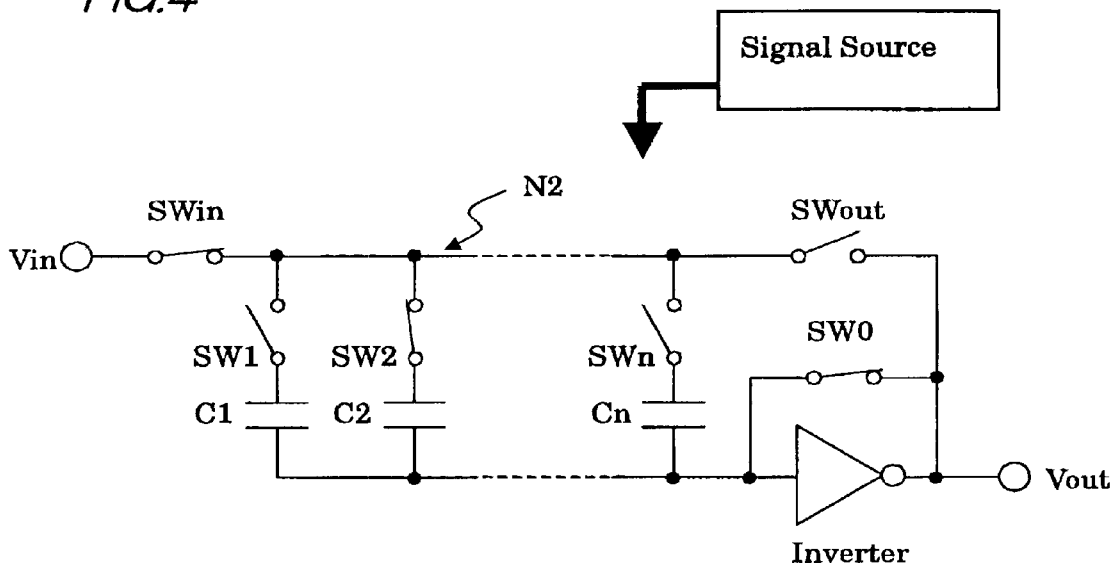
FIG. 4 is a circuit diagram showing a third embodiment of a weighted mean calculation circuit according to the invention.

In FIG. 4, the configuration including an inverting amplifier (inverter), n capacitors C1 through Cn whose one end is connected to the input thereof, and a switch SW0 provided to short-circuit between the input and output of the inverting amplifier is identical to that in FIG. 1. Also, the other ends of the capacitors C1 through Cn are connected to a node N2, to which the respective capacitors are commonly connected, via the switches SW1 through SWn. These switches are different from the toggle switch in FIG. 1, but the switches are simple switches that select whether connection or non-connection is made to the node N2. A switch SW in is provided between the node N2, at which the capacitors C1 through Cn are commonly connected via a switch, and the input signal terminal Vin, and a switch SW out is provided between the note N2 and the output terminal Vout that is an output of the inverting amplifier. As has been seen in FIG. 4, with the configuration, the only one input terminal Vin is there, into which a plurality of signal voltages are inputted through the input terminal one after another.

Figure 5:
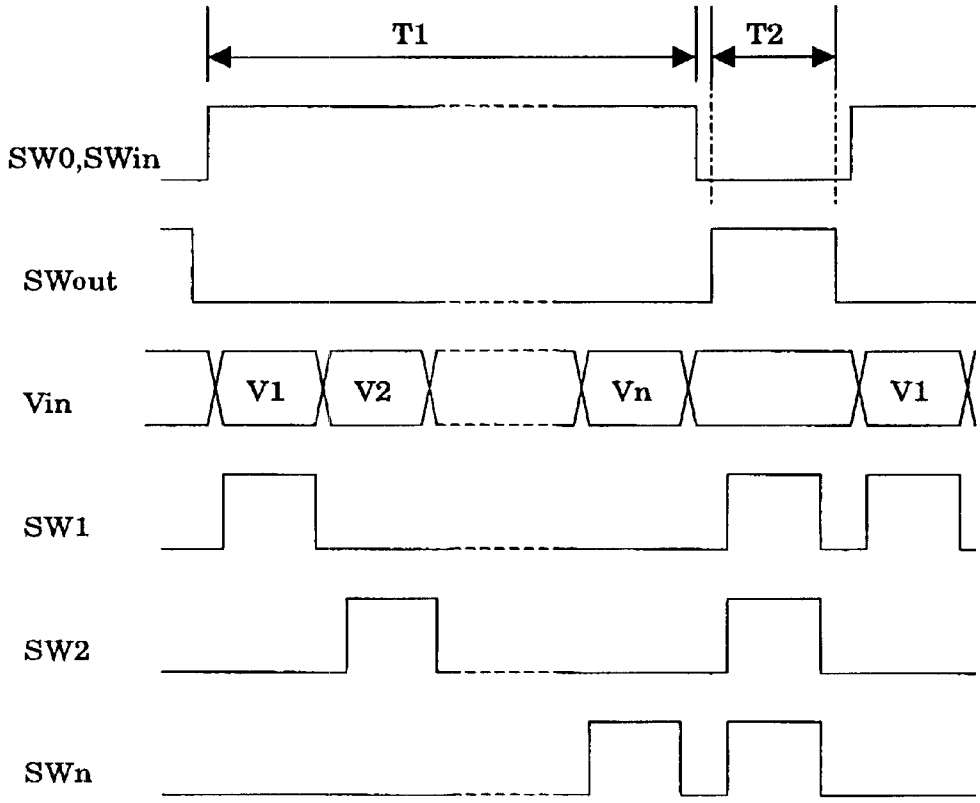
FIG. 5 is a timing chart explaining the operation in regard to FIG. 4.

Next, a description is given of the actions with reference to the timing chart in FIG. 5. FIG. 5 is a view showing ON and OFF of switches and an input signal Vin. With respect to the switches, "H" indicates a state of "ON" while "L" indicates a state of "OFF". The switches SW0 and SW in in FIG. 4 are controlled by the same control signals, and correspond to signals of Φ1 in FIG. 2 and FIG. 3. Also, the control signals of the switch SWout correspond to signals of Φ2 in FIG. 2 and FIG. 3.

The configuration in FIG. 4 basically includes two modes, one of which is an input operation mode of the term T1 and the other of which is an output operation mode of the term T2. In the input operation mode of the term T1, the switches SW0 and SWin are turned on, and SWout is turned off. At this time, as the input signal Vin, analog signals that are one by one sampled like V1, V2, . . . , Vn as shown in the drawing, are inputted in a series. While turning on the switches SW1 through SWn one by one corresponding to the input signal, signal voltages are accumulated in the capacitors C1 through Cn. After the input signals to be held are stored in the capacitors C1 through Cn by the action, the term shifts to T2, wherein the SW0 and SWin are turned off, and the SWout is turned on. In the term of T2, all of the switches SW1 through SWn are turned on, and the capacitors C1 through Cn are connected between the input and output of the inverting amplifier in parallel. At this time, as in FIG. 1, since the charges accumulated in the respective capacitors are shared to the capacitors C1 through Cn connected in parallel, a weighted mean value that is expressed in the expression (5) is caused to appear in the output terminal Vout.

As described above, resultantly, although output that is the same as that in FIG. 1 can be obtained, it is different from the output in FIG. 1 in that the input is of serial analog data, as has been seen in the timing chart of FIG. 5. In the timing chart of FIG. 5, the input signal Vin indicates sampled signals. However, since the configuration itself in FIG. 4 has a feature of a sampling hold circuit, it is possible to calculate the results of the sampling while carrying out sampling actions even if analog signals are continuously provided, and to output the results. In addition, in the timing chart of FIG. 5, all of the switches SW1 through SWn are turned on in the term T2. However, with respect to the switches, some of the serial input data may be selected to cause some of the switches to be turned on, whereby it becomes possible to calculate partial weighted mean values in the data areas thus selected.

As a detailed example of the circuit shown in FIG. 4, a CMOS inverting amplifier that is composed of a source-grounded type nMOS transistor, an nMOS transistor that is cascode-connected thereto, and a pMOS transistor that operates as a constant-current type load may be used with respect to the inverting amplifier as in FIG. 2. Also, the switches may be composed of a single nMOS switches or CMOS analog switches, whereby a weighted mean calculation circuit that occupies only a small area and can be operated with lower power consumption can be achieved as in FIG. 2.

Figure 10:
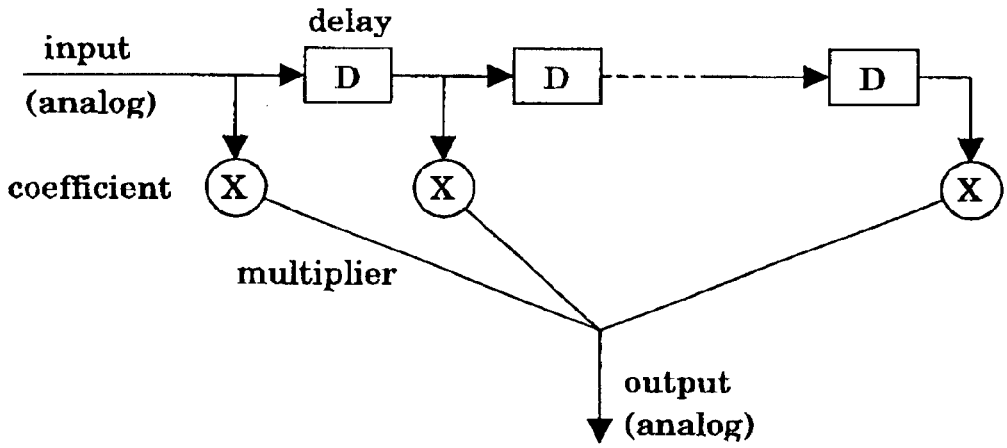
FIG. 10 is a view explaining a transversal filter that requires weighted mean calculations.
Figure 11:
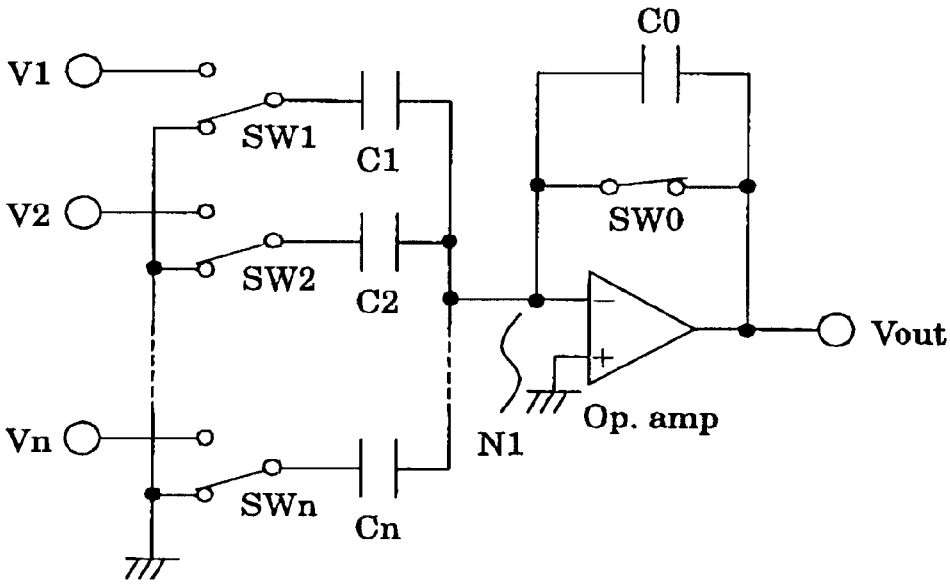
PRIOR ART FIG. 11
FIG. 11 is a circuit diagram showing a prior art weighted mean calculation circuit.

The configuration shown in FIG. 4 has the advantages described in the first embodiment without any change in comparison with the prior arts. Further, since the configuration in FIG. 4 is made into a mode including a sampling hold circuit that is a delay element in a case where the configuration is applied to a transversal filter shown in FIG. 10, there is another advantage by which the circuit scale can be reduced equivalently thereto. On the other hand, though the calculations are enabled immediately after data are inputted since the data are inputted in parallel in the mode shown in FIG. 1, in the configuration shown in FIG. 4 only a weighted mean value will be calculated only once with respect to n data inputs. There is still another advantage in that, since the input signal line is singular, the signal line is not complicated when a plurality of such circuits are provided in parallel to each other. Therefore, it is better to selectively use the configurations in FIG. 1 and FIG. 4 in compliance with the uses.

Embodiment 4

In a case where the circuit in FIG. 1 or FIG. 4 is actually constructed by a CMOS device in an LSI, it is necessary to determine a coefficient of weighting of a weighted mean value in advance. However, there are cases where it is further preferable to vary the coefficient of the weighting from outside in specified uses. An embodiment that can meet such a request is shown in FIG. 6.

Figure 6:
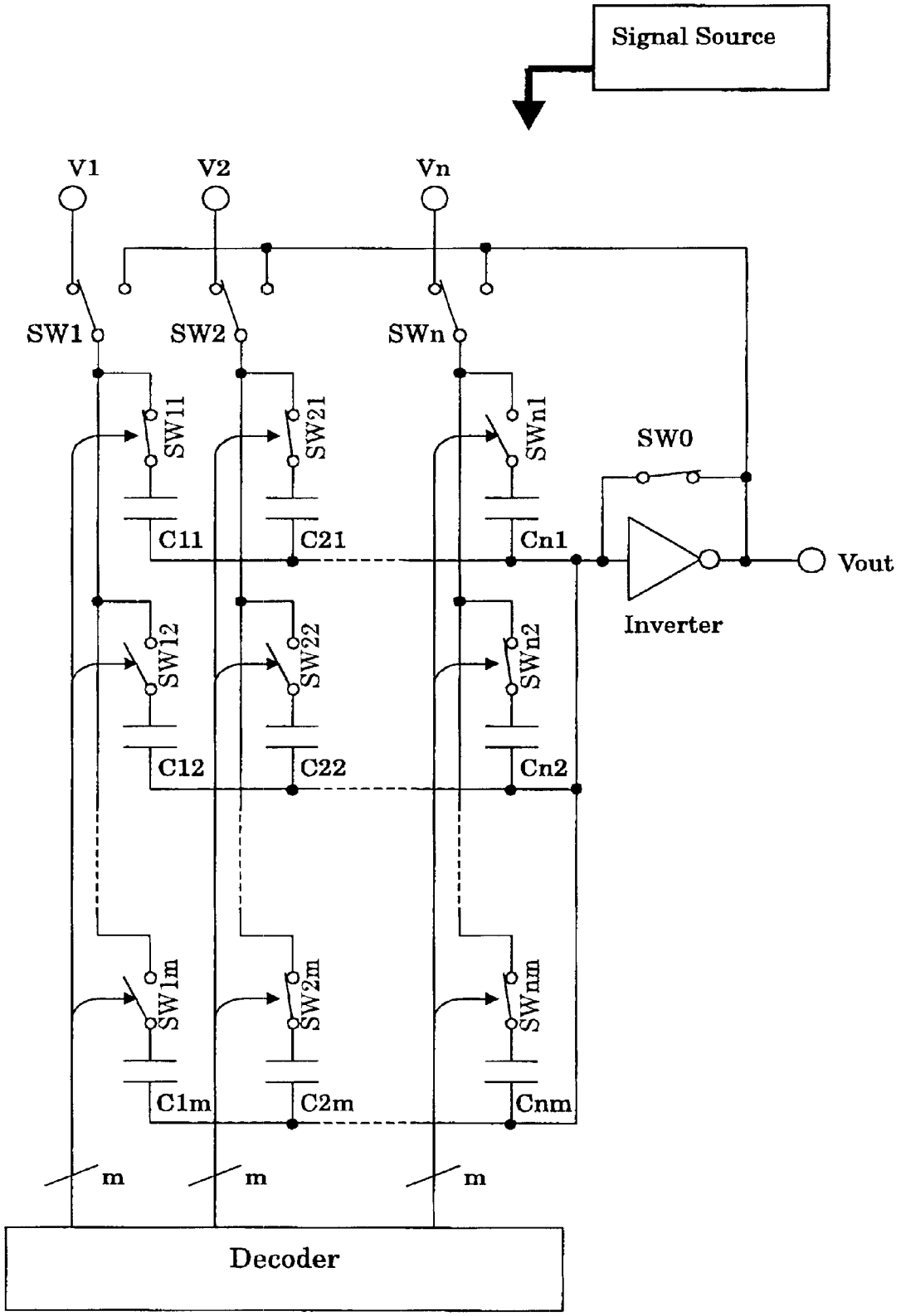
FIG. 6 is a circuit diagram showing a fourth embodiment of a weighted mean calculation circuit according to the invention.

FIG. 6 shows an embodiment in which the respective capacitors C1 through Cn in FIG. 1 are divided into m capacitors connected in parallel to each other. The configuration thereof includes an inverting amplifier (inverter); n*m capacitors C11 through Cnm whose one end is connected to the input; a switch SW0 that is provided to short-circuit between the input and output of the inverting amplifier; switches SW11 through SWnm that are provided at the other end of the capacitors C11 through Cnm; switches SW1 through SWn to control whether the capacitors C11 through Cnm are connected to the input signal voltages V1 through Vn via the switches or connected to the output terminal of the inverting amplifier; and a decoder corresponding to a control section to control ON and OFF of the switches SW11 through SWnm. Also, the number of control signal lines from the decoder becomes the number of switches provided at the respective capacitors, that is, n*m lines.

In FIG. 6, in connection with signals of the signal input terminal V1, m capacitors are provided with respect to one signal in such a manner that capacitors C11 through C1*m* are provided via the switches SW11 through SW1*m* and capacitors C21 through C2*m* are provided via the switches SW21 through SW2*m*. In such a configuration, if the capacitors C11 through Cnm have the same capacitance value, the coefficients that weight the weighted mean values of V1 through Vn correspond to the number of switches with respect to the respective signals, for example, switches SW1 through SW1*m* for V1 or switches SW21 through SW2*m* for V2, which are turned on. Therefore, if the number of switches that are turned on is controlled and varied by the decoder from the outside, it is possible to vary the ratio of the coefficients that becomes the weighting of respective input voltage values in the weighted mean calculations.

In the above description, the respective capacitors C11 through Cnm have been described on the assumption that all the capacitors have the same capacitance value. However, in this case where the capacitance values are the same value, it is possible to vary the coefficients in only 0 through m where the capacitance is divided into m with respect to respective signals. For example, where m=4, the coefficients can be varied only from 0 to 4. Therefore, if the ratio of the capacitance divided with respect to one signal line is made into 2 to the power of m (m is the integral number) like 1:2: . . . :$2^{(m-1)}$, it is possible to expand the ratio of capacitance to $2^m$ with m pieces of capacitance. For example, where m=4 is established and Ci1:Ci2:Ci3:Ci4 (i is 1 through n) is made into 1:2:4:8, the ratio of capacitance may have a coefficient from 0 through 15. Thus, by making the ratio of divided capacitance into a power of 2, it is possible to maximize the range of variation of weighting with a slight number of control signal lines.

Embodiment 5

Figure 7:
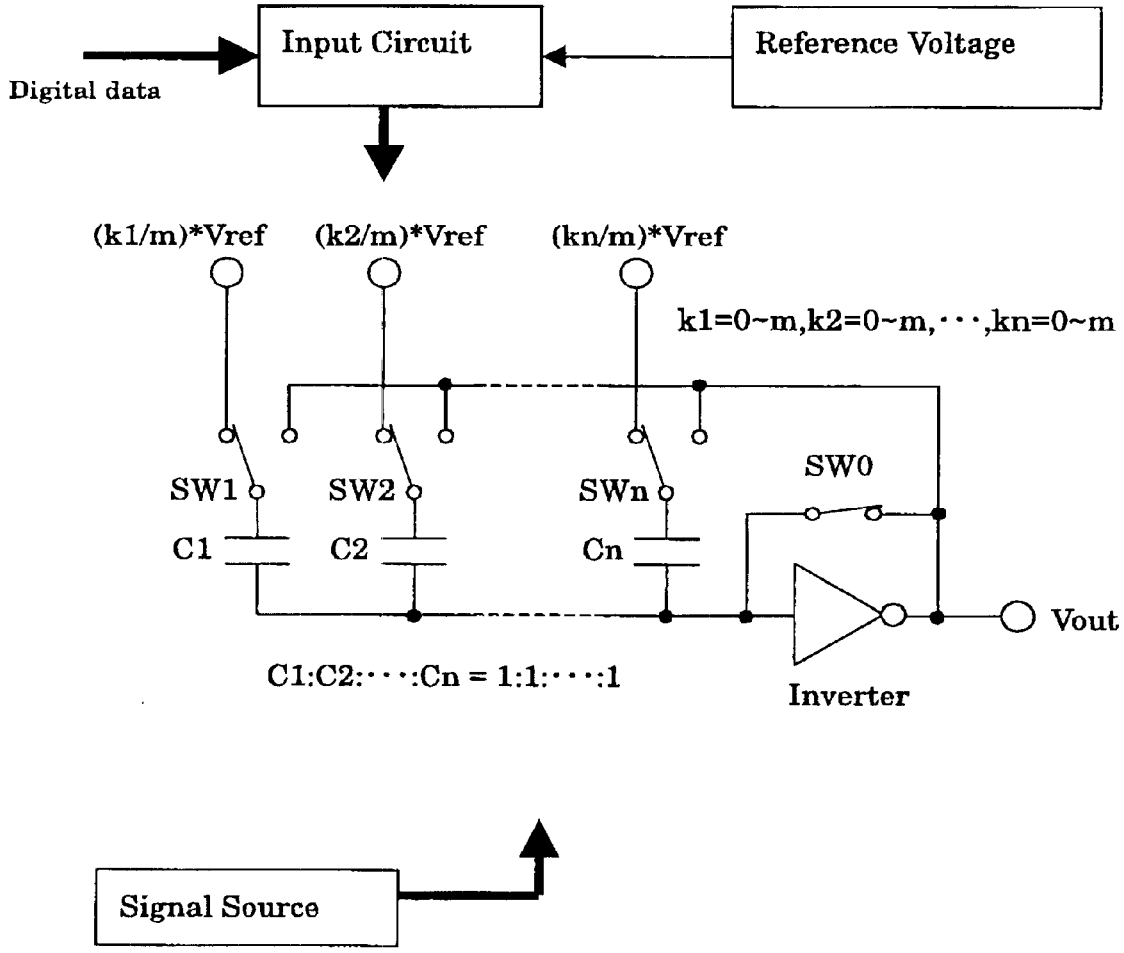
FIG. 7 is a circuit diagram showing a fifth embodiment that constitutes a D/A converter by applying a weighted mean calculation circuit according to the invention thereto.

The above descriptions were based on the assumption that filtering is carried out with respect to signals that are inputted from outside as input signals. However, it becomes possible to construct a D/A converter by providing a reference voltage, which is internally generated, as an input voltage. FIG. 7 shows an embodiment in which a D/A converter is constructed by applying a weighted mean calculation circuit according to the invention thereto.

The configuration shown in FIG. 7 is basically the same as that shown in FIG. 1. However, they differ in that the input voltages are controlled and inputted. In FIG. 7, it is constructed that either one of voltages generated by equally dividing the range between the reference voltage Vref and the ground into m pieces, 0, (1/m)*Vref, (2/m)*Vref, . . . , Vref is provided to the input voltage value. These voltages are constructed by the input circuit, which transforms some of digital data by using reference voltage Vref. If all of the capacitance values of C1 through Cn are equally set, the weighted output voltage becomes as in the expression (6):

$$Vout=\{k/(n*m)\}*Vref \tag{6}$$

$$K=k1+k2+\ldots+kn \tag{7}$$

In the expression (6), k becomes an integral number from 0 to n*m. For example, where n=16 and m=16 are established, voltages in units of 1/256 of the reference voltage can be outputted. That is, a D/A converter of 8 bits can be achieved. For example, when outputting 1/256*Vref, 1/16*Vref may be applied to one of the sixteen capacitors, and the remaining capacitors may be given 0 (ground potential). Also, in order to obtain 255/256*Vref, 15/16*Vref may be applied to one of the sixteen capacitors, and the remaining capacitors may be given Vref. Thus, the weighted mean calculation circuit according to the invention can be used as a D/A converter that is capable of outputting further detailed steps of voltage with respect to the steps of given signal voltage by controlling the voltage applied to respective terminals.

Embodiment 6

The fifth embodiment is an example that can be used as a D/A converter. However, FIG. 8 shows an embodiment that is capable of generating further efficient small output steps with a slight number of control signals with respect to the reference voltage provided from the outside.

Figure 8:
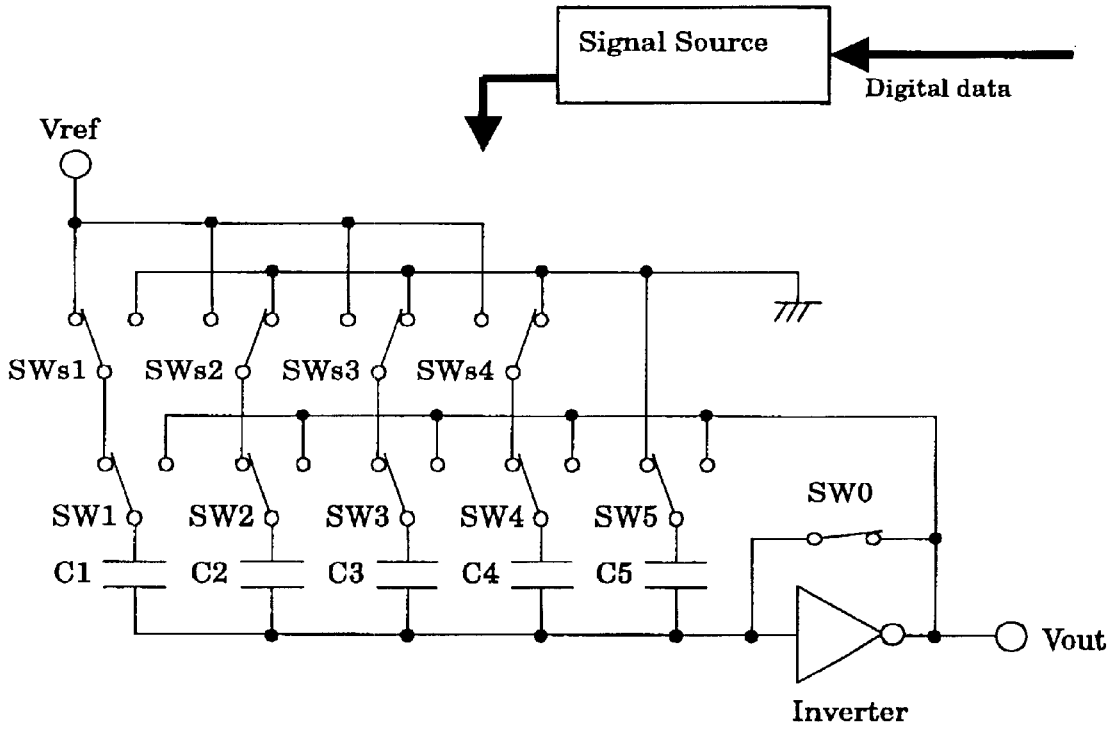
FIG. 8 is a circuit diagram showing a sixth embodiment that constitutes a D/A converter by applying a weighted mean calculation circuit according to the invention thereto.

FIG. 8 shows a D/A converter that can output 4 bits by controlling an input signal by four switches. The basic configuration thereof has almost no change from the embodiments described above. However, toggle switches SWs1 through SWs4 that selectively provides either one of the two potentials of Vref or the ground as an input signal are additionally attached to the input terminal side of the capacitance. This is such a type where, although in the fifth embodiment the switches are not illustrated and a voltage is provided in steps of 1/m, in this embodiment them is made into 1 (m=1), and the intermediate potentials are excluded.

A characteristic point of the sixth embodiment resides in that the ratio of the respective capacitance values C1:C2:C3:C4 are made into 8:4:2:1. Also, a capacitor C5 that has the capacitance value that is the same as C4 can provide the ground potential when inputting a signal is added, whereby the weighting of C1 through C4 are made into ½, ¼, ⅛, and 1/16 in order to normalize at 4-bit output, and the total capacitance is made into 16 (arbitrary unit). Thereby, the output voltage becomes as follows;

$$Vout=(k1/2+k2/4+k3/8+k4/16)*Vref \quad (8)$$

Coefficients k1 through k4 in the expression (8) become 0 or 1 by connections of the switches SWs1 through SWs4 corresponding to the respective coefficients. That is, the coefficient is 1 when the switches are connected to Vref, and becomes 0 when they are connected to the ground. Therefore, by controlling these switches according to control signals of the signal source, Vout is constructed in a step of 1/16 of the reference voltage Vref on the basis of digital data, wherein it is understood that the embodiment can operate as a D/A converter capable of obtaining 16 steps of output from 0 through (15/16)*Vref.

Thus, by setting the ratio of capacitance to a ratio corresponding to 2 to the power of J (J is the integral number) like 1:2:4: . . . , it is possible to obtain signal outputs that are efficiently divided with a slight number of control signals between two reference voltages (in FIG. 8, Vref and the ground).

Embodiment 7

Figure 9:
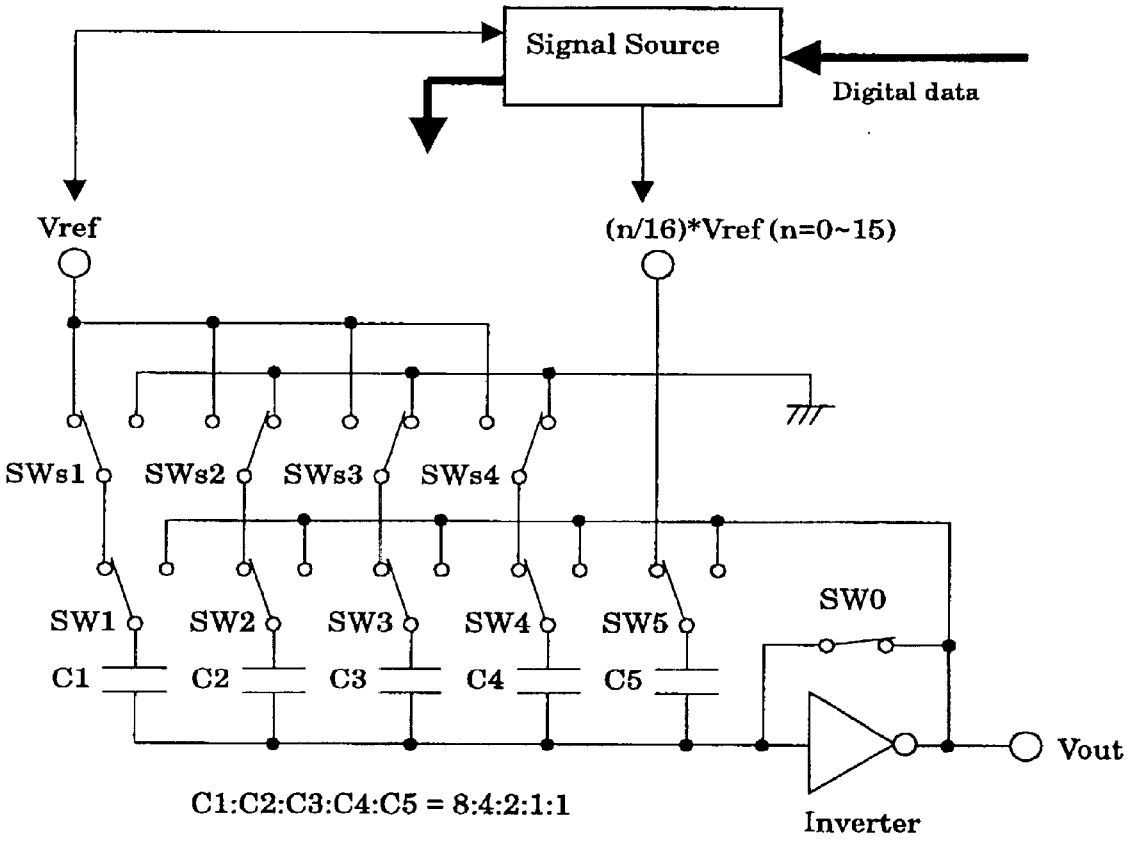
FIG. 9 is a circuit diagram showing a seventh embodiment that constitutes a D/A converter by applying a weighted mean calculation circuit according to the invention thereto.

Next, FIG. 9 shows an embodiment in which the embodiment in FIG. 7 and that in FIG. 8 are combined to obtain signal outputs in minute steps with a small circuit configuration. The configuration shown in FIG. 8 needs 16 units of capacitors in order to obtain outputs of 4 bits. In order to raise resolution in further minute steps, it is necessary to increase the number of capacitors. For example, if the resolution is raised, the number of capacitors needed is increased at a ratio of 2 to the power of J (J is the integral number) like 5 bits needing 32 units and 6 bits needing 64 units. FIG. 9 shows a method for raising the resolution without increasing the number of capacitors as much as possible.

Other than the voltages provided to the capacitor C5, the configuration in FIG. 9 is identical to that in FIG. 8. In FIG. 8 the ground potential is always provided when inputting signals to capacitors. However, in this embodiment the corresponding potential is made into Vref/n(n is the integral number of 0 through 15), whereby an output of 8-bit resolution can be obtained. The outputs obtained will be as follows by methods of providing signals in FIG. 9.

$$Vout=\{k1/2+k2/4+k3/8+k4/16+(1/16)*(n/16)*Vref \quad (9)$$
$$=(k/16+n/256)*Vref$$

$$k=8*k1+4*k2+2*k3+k4 \quad (10)$$

Since, in the expression (9), any integral number 0 through 15 may be employed with respect to k and n, output voltages Vout can be from 0 through (255/256)*Vref in steps of (1/256)*Vref, wherein it is understood that an 8-bit D/A converter is constructed. Also, it necessary to use total 256 capacitors to merely extend the configuration in FIG. 8 to 8 bits configuration. However, since the Vref/n (n is the integral number of 0 through 15) provided to C5 can be formed by the configuration shown in FIG. 8, with the configuration shown in FIG. 9, 8-bit resolution can be obtained by two times number of capacitors as the configuration in FIG. 8. That is, the configuration can be achieved by 32 capacitors as the number of capacitors, wherein it is possible to make the circuit scale small.

FIG. 7 through FIG. 9 show examples in which a weighted mean calculation circuit is used as a D/A converter. Also, in cases where the weighted mean calculation circuit is used as a D/A converter, there is an advantage of obtaining outputs that are not influenced by offset voltages of an inverting amplifier, and simultaneously there is another advantage of bringing about a decrease in power consumption and a reduction in circuit scale.

According to the configurations of the respective embodiments described above, a weighted mean calculation circuit that does not have any offset with respect to a plurality of inputted signals and can directly output weighted mean values of normal output can be brought about. Furthermore, with respect to a weighted mean calculation circuit that has been publicly known, it is possible to easily design a configuration that can vary the weighting from the outside, and power consumption can be decreased while reducing the area of occupancy.

The entire disclosure of Japanese Patent Application No.2000-317998 filed on Oct. 15, 2001 including specification, claims, drawings and summary are incorporated herein by reference in its entirety.

What is claimed is:

1. A weighted mean calculation circuit for calculating a normalized weighted mean value Σ (Vk*Ck)/Σ Ck (k=1, . . . , n) weighted by Ck (k=1, . . . , n) on the basis of a plurality of input voltage signals Vk (k=1, . . . , n), said weighted calculation circuit having a plurality of input terminals for receiving a plurality of input voltage signals, and an output terminal for providing the normalized weighted mean value, said circuit comprising:

an inverting amplifier, said inverting amplifier having an input terminal and an output terminal;

a plurality of capacitors, each of said plurality of capacitors having a first terminal and a second terminal, each of said first terminals of said plurality of capacitors connected to the input terminal of said inverting amplifier;

the capacitive value of each of said plurality of capacitors selected to provide a weighting coefficient associated with each capacitor;

a feedback switch connected between the input and the output terminals of said inverting amplifier, said feedback switch having an open position and a closed position; and a plurality of switches, one of said plurality of switches associated with each of said plurality of capacitors, said plurality of switches having first and second switch positions, said plurality of switches coupling the second terminals of said plurality of capacitors to said input voltage signals when said plurality of switches is in the first switch position, and said plurality of switches coupling said plurality of capacitors to the output of said inverting amplifier when said plurality of switches is in the second switch position.

2. The weighted mean calculation circuit as set forth in claim 1, further comprising:

an input operating mode in which said feedback switch is closed and said plurality of switches is in the first switch position to apply said plurality of input voltage signals to the second terminals of said plurality of capacitors; and an output operating mode in which said feedback switch is open, and said plurality of switches is in the second switch position to apply the input voltage signals stored in said plurality of capacitors to the output terminal of said inverting amplifier;

whereby said circuit calculates a weighted mean value of the plurality of input voltage signals by multiplying said input voltage signals by respective weighting coefficients associated with each of said plurality of capacitors.

3. A weighted mean calculation circuit for calculating a normalized weighted mean value $\Sigma$ (Vk*Ck /$\Sigma$ Ck (k=1, . . . , n), weighted by Ck (k=1, . . . n), on the basis of a plurality of input voltage signals Vk (k=1, . . . , n), said circuit comprising:

an input terminal of said circuit to receive the plurality of input voltage signals in serial format with a predefined time for each of the plurality of input voltage signals;

an output terminal of said circuit to provide the normalized weighted mean value of the plurality of input voltage signals;

an inverting amplifier, said inverting amplifier having an input terminal and an output terminal, said output terminal of the inverting amplifier coupled to the output terminal of said circuit;

a plurality of capacitors, each of said plurality of capacitors having a first terminal and a second terminal, each of said terminals of said plurality of capacitors coupled to the input terminal of said inverting amplifier, the capacitive value of each of said plurality of capacitors selected to provide a weighting coefficient associated with each of said plurality of capacitors; and a plurality of switches, one of said plurality of switches associated with each of said plurality of capacitors, said plurality of switches having first and second switch positions, said plurality of switches coupling the second terminals of said plurality of capacitors to said input voltage signals when said plurality of switches is in the first switch position, and said plurality of switches coupling said plurality of capacitors to the output of said inverting amplifier when said plurality of switches is in the second switch position.

4. The weighted mean calculation circuit as set forth in claims 1 or 3 said circuit further comprising:

at least one of said plurality of capacitors further comprising a second plurality of capacitors;

a controllable switch in series with each of said second plurality of capacitors, the second plurality of capacitors and the controllable switches connected in parallel; and a decoder, said decoder having a plurality of control signals, one control signal for each controllable switch associated with the second plurality of capacitors, said controllable switches responsive to said decoder control signals to couple one or more of the second plurality of capacitors to the input voltage signals, thereby controlling the weighting coefficient associated with said at least one of said plurality of capacitors.

5. The weighted mean calculation circuit as set forth in claim 4, wherein the ratio of capacitance values of the second plurality of capacitors is in a relationship of 2 to the power of J, where J is an integral number, such as 1:2:4:8.

6. The weighted mean calculation circuit as set forth in claims 1, 2, or 3 wherein said inverting amplifier is a CMOS inverting amplifier, said CMOS inverting amplifier comprising:

a first MOS transistor with a source terminal, a gate terminal and a drain terminal, said source terminal referenced to ground, said a gate terminal coupled to the input terminal of said inverting amplifier;

a second MOS transistor having the same polarity type as that of the first MOS transistor and having a source terminal, a gate terminal and a drain terminal, said source terminal coupled to the drain terminal of the first MOS transistor in a cascode amplifier arrangement, said gate terminal referenced to a bias potential and said drain terminal coupled to the output terminal of said inverting amplifier; and a third CMOS transistor having a polarity type opposite to the polarity type of the first and second MOS transistors, said third CMOS transistor having a source, a drain and a gate terminal, said third CMOS transistor having at least one of said terminals coupled to the drain terminal of said second MOS transistor as a load.

* * * * *